US005157409A

United States Patent [19]

Hamin

[11] Patent Number: 5,157,409

[45] Date of Patent: Oct. 20, 1992

[54] CAM LOCK ANTENNA MOUNTING ASSEMBLY

[75] Inventor: Joseph A. Hamin, Cherry Hill, N.J.

[73] Assignee: Radio Frequency Systems, Inc., Marlboro, N.J.

[21] Appl. No.: 741,840

[22] Filed: Aug. 7, 1991

[51] Int. Cl.[5] ..... H01Q 1/32

[52] U.S. Cl. ..... 343/715

[58] Field of Search ..... 343/713, 715

[56] References Cited

U.S. PATENT DOCUMENTS 3,230,533 1/1966 Brill ..... 343/713

4,065,092 12/1977 Spinks et al. ..... 343/713

*Primary Examiner*—John D. Lee

*Assistant Examiner*—Robert E. Wise

*Attorney, Agent, or Firm*—Ware, Fressola, Van Der Sluys & Adolphson

[57] ABSTRACT

A removable antenna mounting device is adapted to receive an antenna such as that used for a mobile cellular telephone. The antenna is mounted to an antenna mounting member which operationally engages a trunk lid clamp member secured to the trunk lid of the vehicle. In order to provide positive engagement between the antenna mounting member and the trunk lid clamp member, an eccentric cam connection is provided. The eccentric cam connection is designed to facilitate the removal of the antenna from the trunk lid for storage in the trunk.

17 Claims, 4 Drawing Sheets

CAM LOCK ANTENNA MOUNTING ASSEMBLY

BACKGROUND OF THE INVENTION

1. Field of the Invention

The present invention relates to vehicular antennas and more particularly to a removable antenna mounting assembly for antennas adapted to receive and transmit higher-frequency signals, such as cellular telephone signals.

2. Description of the Prior Art

Mobile cellular telephone service is becoming exceedingly popular and is very much in demand. Since cellular telephones operate in a frequency band considerably higher than the normal AM/FM radio, separate cellular telephone antennas must be installed on vehicles. Oftentimes, the antenna installation is on the trunk lid of the vehicle. Initially, the existence of the cellular antenna on a vehicle was a status symbol but it is now considered a pretentious display that is to be avoided by those in the service industry. Automobile owners dislike the unsightly objects extending from their vehicles and the need for multiple feed cable holes in the vehicle's exterior for body mounted antennas. In addition, cellular telephones are common targets for thieves, and the cellular antenna is literally a flag directing potential thieves to the desired vehicles.

It is desirable to remove the antenna into the trunk of vehicle so as to leave the vehicle's lines clean and streamline when the transmit/receive device is not in use. Removable antennas are also desirable since the antennas, if they are not retractable, are commonly damaged when the vehicle passes through a car wash.

Accordingly, it would be desirable to have a device to secure trunk mounted antenna on the vehicle with the capability of the antenna being quickly and easily removed and stored in the trunk of the vehicle when desired.

SUMMARY OF THE INVENTION

The present invention contemplates an antenna mounting device comprising a trunk lid clamp member with an antenna mounting member releasably secured thereto. An antenna is threadingly secured to the antenna mounting member with the feedline for the antenna extending through the antenna mounting member and into the trunk.

In the present invention, the trunk lid clamp member is U-shaped to slidably receive a portion of the trunk lid therebetween. A pair of securing screws can then be used to couple the trunk lid clamp member to the trunk lid.

Importantly, the antenna mounting device of the present invention has a carefully designed eccentrically actuated cam connection which biases the antenna mounting member into clamping engagement with the trunk lid clamp member yet facilitates its release when desired.

A primary objective of the present invention is to provide an easily removable mounting device for antennas for cellular telephones and the like.

Another objective of the present invention is to provide a removable antenna mounting device that exhibits a very convenient and simple operation for removing and storing the antenna within the trunk.

An additional objective of the present invention is to provide a removable antenna mounting device wherein there is a reliable eccentric cam coupling between the trunk lid clamp member and the antenna mounting member.

A further objective of the present invention is to provide a removable antenna mounting device that is economically fabricated and will enjoy a long life in operation.

The invention will be fully understood when reference is made to the following detailed description taken in conjunction with the accompanying drawings.

Figure 6:
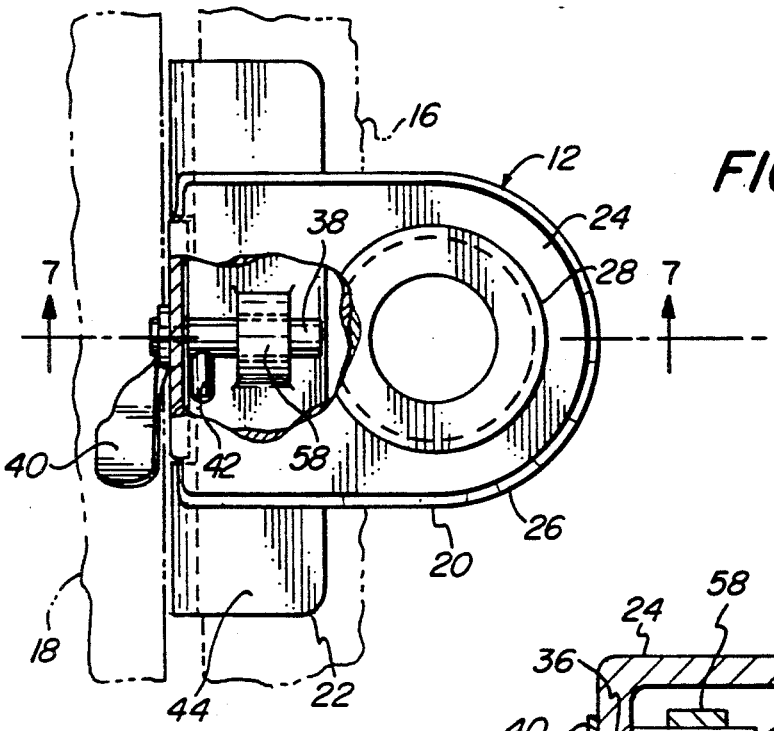
FIG. 6 is a top elevational view of the removable antenna mounting device of the present invention (with portions broken away to reveal internal structure) as mounted on the trunk lid of a vehicle shown in phantom line.
Figure 8:
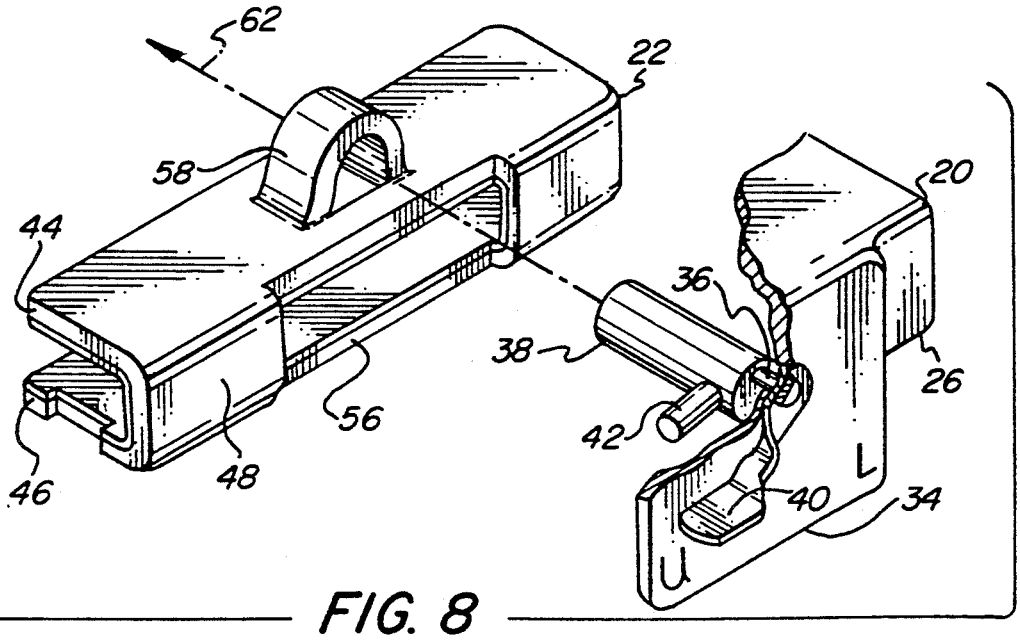
Figure 9:
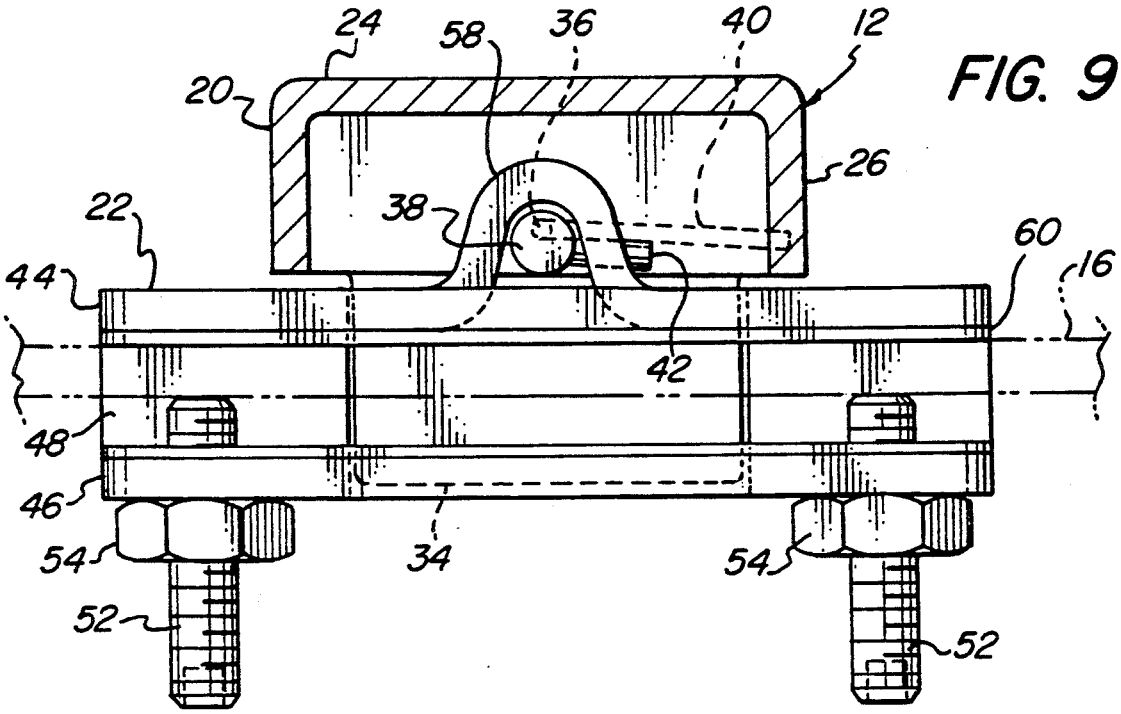
Figure 10:
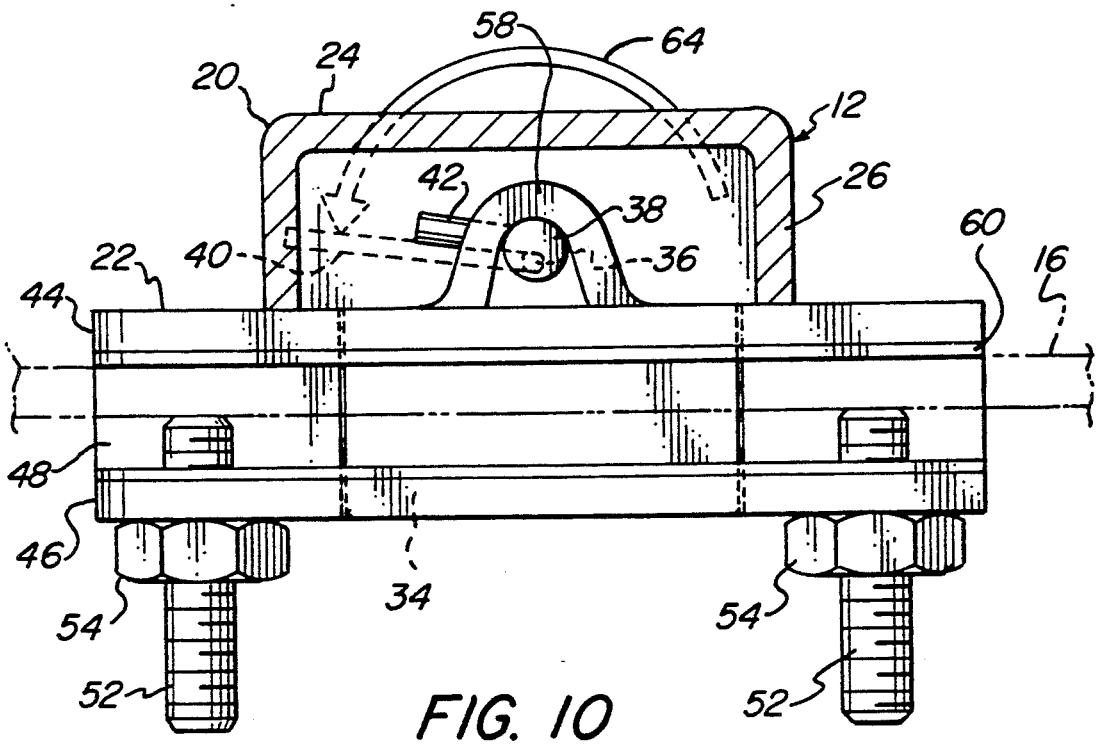

FIG, 7 is a sectional view taken along the 7—7 line of FIG. 6;

FIG. 8 is an exploded perspective view of the removable antenna mounting device with a portion of the antenna mounting member broken away to reveal the eccentric cam pin thereon; and FIGS. 9 and 10 are side elevational views of the removable antenna mounting device mounted on a trunk lid (shown in phantom line) illustrating the operational engagement of the eccentric cam with the locking loop as the handle is moved between its unlocked and locked positions.

DESCRIPTION OF THE PREFERRED EMBODIMENTS

Figure 1:
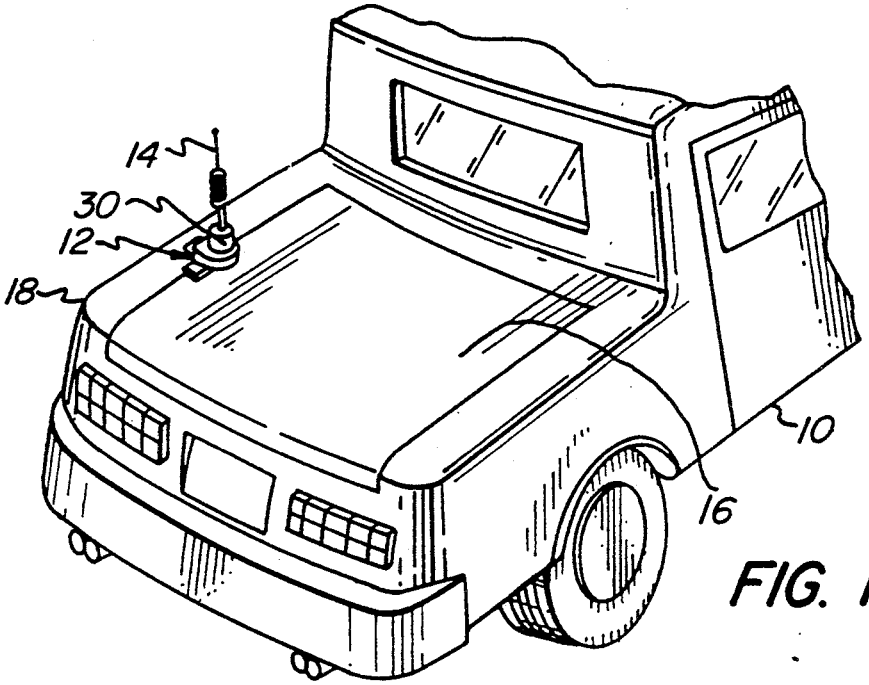
FIG. 1 is a perspective view of a cellular antenna mounted on the trunk lid of a vehicle by a removable antenna mounting device constructed in accordance with the present invention.
Figure 2:
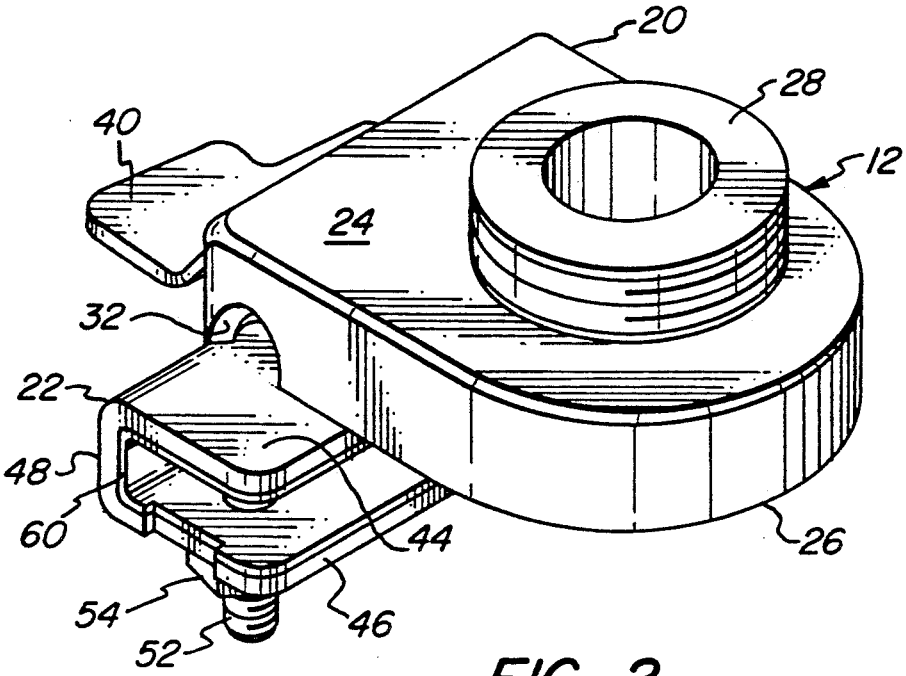
FIG. 2 is a top perspective view of the removable antenna mounting device of the present invention.
Figure 3:
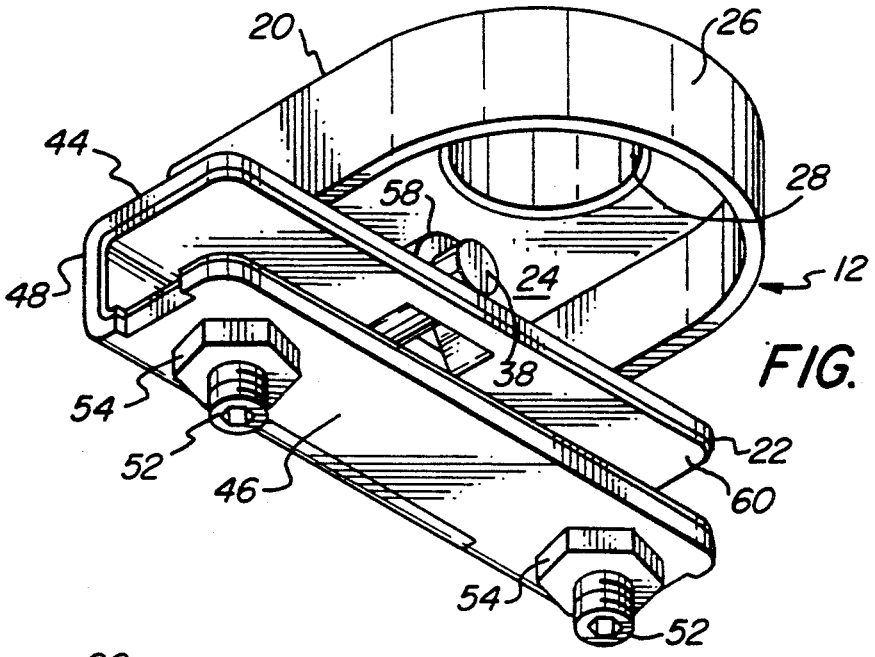
FIG. 3 is a bottom perspective view of the removable antenna mounting device of the present invention.
Figure 4:
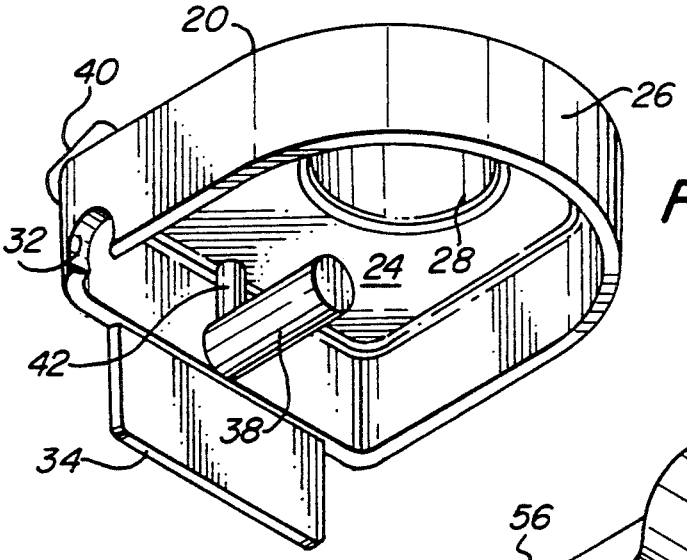
FIG. 4 is a bottom perspective of the antenna mounting member.
Figure 5:
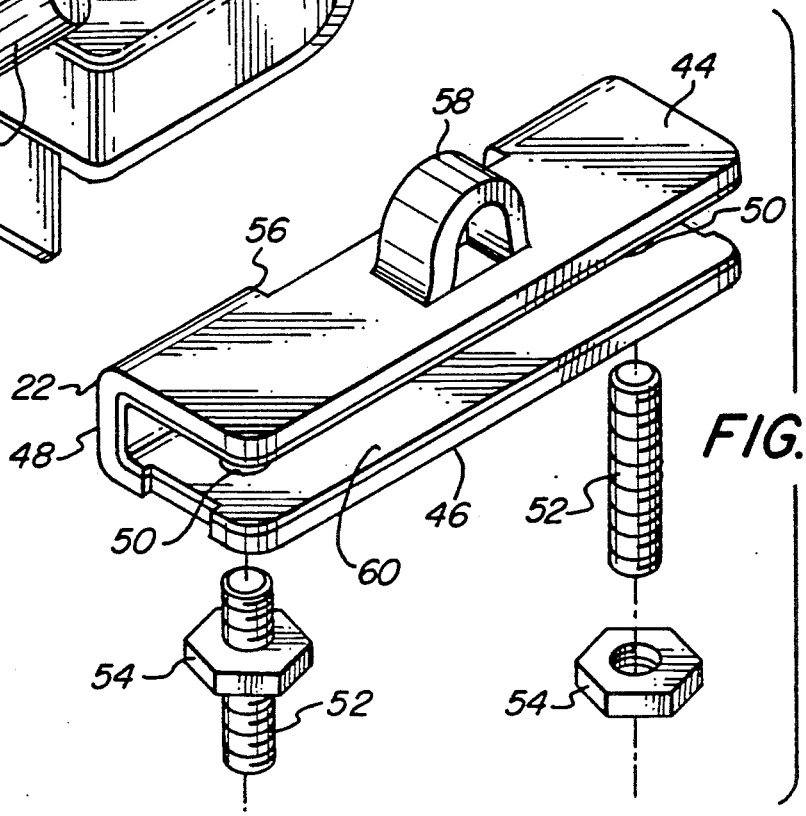
FIG. 5 is a top perspective view of the trunk lid clamp member with the locking screws and nuts being inserted therein.

Turning first to FIG. 1, therein illustrated is a motor vehicle 10 with an antenna mounting device, generally indicated by the numeral 12, for mounting a transmit/-receive antenna 14 for a mobile cellular telephone (not shown). The antenna mounting device 12 is mounted on a trunk lid 16 adjacent a rear fender 18 of the motor vehicle 10.

As shown in FIGS. 2 through 5, the antenna mounting device 12 is comprised of an antenna mounting member 20 and a trunk lid clamp member 22. The antenna mounting member 20 has a platform 24 with a downwardly extending flange 26 around its periphery. Extending through and fixedly secured to the platform 24 is a tubular lug 28 threaded on its exterior surface for threadingly receiving a mating portion 30 (FIG. 1) of the antenna 14. A transmission wire (not shown) for the antenna 14 extends through the center of the lug 28 and through a semi-circular notch 32 in the flange 26 and into the trunk of the motor vehicle 10.

Figure 7:
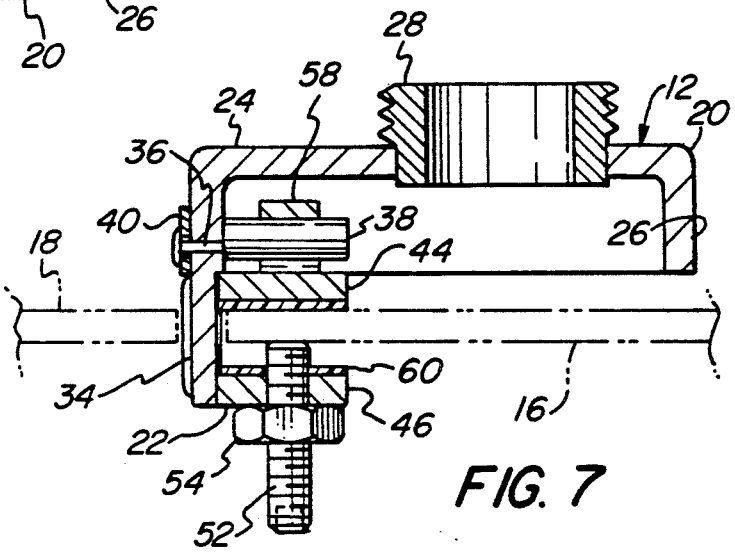

Extending downwardly from the flange 26 is a rectangular alignment tab 34. As seen in FIG. 7, pivotally mounted through the flange 26 adjacent the alignment tab 34 is a cylindrical pivot pin 36 with a cylindrical cam pin 38 fixedly secured on one end of the pivot pin 36 and a user actuated handle 40 fixedly secured on the other end thereof for pivotal movement therewith. The cam pin 38 is eccentrically mounted on the pivot pin 36. A stop pin 42 is cantilevered from the cam pin 38 adjacent the flange 26.

The trunk lid clamp member 22 is in the form of an elongated U-shaped channel having an upper leg 44 and a lower leg 46 connected by central portion 48. The lower leg 44 of the trunk lid clamp member 22 has spaced apart threaded apertures 50 which receive allen-headed locking screws 52 extending into the interior of the trunk lid clamp member 22. Locking nuts 54 are threadingly received on the locking screws 52. The central portion 48 of the trunk lid clamp member 22 defines an indexing notch 56 midway therealong dimensionally sized to cooperate with the alignment tab 34 to align the same. Centrally located on the upper leg 44 is a cam lock loop 58 dimensionally sized to receive and operationally cooperate with the cam pin 38 to hold the antenna mounting member 20 in assembly with the trunk lid clamp member 22 as will be explained further hereinafter. The interior of the trunk lid clamp member 22 is lined with a protective material 60 such as a plastic foam so as to inhibit damage to the trunk lid 16.

In using the antenna mounting device 12, the trunk lid clamp member 22 is first attached to the trunk lid 16 by inserting the trunk lid clamp member 22 on the trunk lid 16 as shown in FIGS. 6 and 7. The locking screws 52 are tightened to force the trunk lid 16 into intimate contact with the protective material 60 on the upper leg 44 of the trunk lid clamp member 22 in a clamping relationship. The locking nuts 54 on the locking screws 52 are then tightened against the lower leg 46 to prevent the locking screws 52 from backing off from their clamping relationship with the trunk lid 16. It should be appreciated that the thickness of the central portion 48 is dimensionally sized to fit neatly in the gap between the trunk lid 16 and rear fender 18 of the motor vehicle 10.

To mount the antenna 14, the mating portion 30 is first threadingly received on the threaded lug 28 with the antenna cable (not shown) extending down through the center of the lug 28 and through the semi-circular notch 32 in the flange 26. With the user actuated handle 40 rotated to its unlocked position shown in FIG. 8, the cam pin 38 can be inserted through the cam lock loop 58, as indicated by arrow 62, until the alignment tab 34 seats in the indexing notch 56. As shown in FIGS. 9 and 10, with the antenna mounting member 20 thus positioned, the user actuated handle 40 can then be moved to its locked position by rotating the user actuated handle 40 as indicated by arrow 64 thereby causing the cam pin 38 to engage the cam lock loop 58 due to the eccentric mounting of the cam pin 38 on the pivot pin 36. Engagement of the cam pin 38 with the cam lock loop 58 in this locking maneuver forces a portion of the flange 26 of the antenna mounting member 20 into an abutting relationship with the upper leg 44 of the trunk lid clamp member 22. The stop pin 42 prevents excessive movement of the cam pin 38 when it abuts the upper leg 44 in either of its locked or unlocked positions.

The antenna mounting device is preferably made of metal material such as steel or aluminum but it should be apparent to those skilled in the art that it may be manufactured from other suitable materials which exhibit weather and wear resistant qualities. The antenna mounting device 12 of the present invention can be made in a variety of sizes to conform to various antenna styles and sizes.

Thus, the present invention provides a removable antenna mounting device capable of positioning an antenna on the trunk lid of a vehicle and permitting easy removal and storage thereof in the trunk. The removable antenna mounting device has a unique eccentric cam connection used to secure the antenna mounting member to the trunk lid clamp member while maintaining the antenna in an operational position.

The preferred embodiment described above admirably achieves the objectives of the invention; however, it will be appreciated that departures can be made by those skilled in the art without departing from the spirit and scope of the invention which is limited only by the following claims.

What is claimed is:

1. An assembly for mounting an antenna on a trunk lid of a motor vehicle comprising:

an antenna mounting member having means for mounting an antenna thereon and cam means movable between an unlocked position and a locked position;

a clamp member releasably securable to the trunk lid and having means dimensionally sized to accept and cooperate with said cam means to hold said clamp member and said antenna mounting member in assembly when said cam means is in said locked position.

2. The assembly for mounting an antenna in accordance with claim 1 wherein said dimensionally sized means is a surface on said clamp member engageable by said cam means to bias said clamp member and said antenna mounting means into locking engagement when said cam means is in said locked position.

3. The assembly for mounting an antenna in accordance with claim 2 wherein said surface of said dimensionally sized means is defined as an inner surface of a cam lock loop on said clamp member.

4. The assembly for mounting an antenna in accordance with claim 3 wherein said cam means is dimensionally sized for insertion into said cam lock loop and said cam means engages said inner surface of said cam lock loop as said cam means is moved from its unlocked position to its locked position to move said clamp member and said antenna mounting member into locking engagement.

5. The assembly for mounting an antenna in accordance with claim 4 wherein said cam means is a cylindrical pin eccentrically mounted for rotation in said antenna mounting member.

6. The assembly for mounting an antenna in accordance with claim 5 wherein said cam means includes a stop pin for limiting rotation of said cylindrical pin.

7. The assembly for mounting an antenna in accordance with claim 5 wherein said cam means includes a user actuated handle for controlling the rotation of said cylindrical pin.

8. The assembly for mounting an antenna in accordance with claim 2 wherein said surface of said dimensionally sized means is a surface defining an opening in said clamp member.

9. The assembly for mounting an antenna in accordance with claim 8 wherein said cam means is dimensionally sized for insertion into said opening and said cam means engages said opening defining surface as said cam means is moved from its unlocked position to its locked position to move said clamp member and said antenna mounting member into locking engagement.

10. The assembly for mounting an antenna in accordance with claim 1 wherein said clamp member defines an indexing opening and said antenna mounting means has an alignment tab dimensionally sized to snugly fit within said indexing opening thereby aligning said antenna mounting means with said clamp member.

11. The assembly for mounting an antenna in accordance with claim 1 wherein said clamp member is a U-shaped channel having upper and lower leg portions joined by a central portion.

12. The assembly for mounting an antenna in accordance with claim 11 wherein said lower leg portion has locking screws thereon for clamping an edge of the trunk lid.

13. The assembly for mounting an antenna in accordance with claim 11 wherein said central portion of said clamp member defines an indexing opening and said antenna mounting means has an alignment tab dimensionally sized to snugly fit within said indexing opening thereby aligning said antenna mounting means with said clamp member.

14. The assembly for mounting an antenna in accordance with claim 11 wherein said dimensionally sized means is a surface on said upper leg of said clamp member engageable by said cam means to bias said clamp member and said antenna mounting means into locking engagement.

15. The assembly for mounting an antenna in accordance with claim 14 wherein said surface of said dimensionally sized means is defined as an inner surface of a cam lock loop extending upwardly from said upper leg of said clamp member.

16. The assembly for mounting an antenna in accordance with claim 15 wherein said cam means is dimensionally sized for insertion into said cam lock loop and said cam means engages said inner surface of said cam lock loop as said cam means is moved from its unlocked position to its locked position to move said clamp member and said antenna mounting member into locking engagement

17. The assembly for mounting an antenna in accordance with claim 1 wherein said antenna mounting member is a platform with a downwardly extending flange around the periphery thereof.

* * * * *